US005695108A

United States Patent [19]

Lee

[11] Patent Number: 5,695,108

[45] Date of Patent: Dec. 9, 1997

[54] MAGAZINE SYSTEM OF A STAPLER

[75] Inventor: Yun-Chung Lee, Taipei Hsien, Taiwan

[73] Assignee: De Poan Pneumatic Corporation, Taipei Hsien, Taiwan

[21] Appl. No.: 611,260

[22] Filed: Mar. 5, 1996

[51] Int. Cl.[6] ..... B25C 5/16

[52] U.S. Cl. ..... 227/109; 227/119; 227/120; 227/135

[58] Field of Search ..... 227/107, 109, 227/119, 120, 135, 139

[56] References Cited

U.S. PATENT DOCUMENTS

| | | | |
|---|---|---|---|
| 3,253,760 | 5/1966 | Doyle et al. | 227/120 |
| 3,633,811 | 1/1972 | Ploen | 227/109 |
| 4,304,349 | 12/1981 | Novak et al. | 227/109 |
| 4,597,517 | 7/1986 | Wagdy | 227/120 X |
| 4,667,865 | 5/1987 | Judge | 227/109 |
| 4,815,647 | 3/1989 | Chou | 227/109 |
| 5,337,945 | 8/1994 | Fehrle et al. | 227/109 |
| 5,522,533 | 6/1996 | Mukoyama et al. | 227/109 |
| 5,556,020 | 9/1996 | Hou | 227/109 |
| 5,605,269 | 2/1997 | Musiani | 227/109 |

FOREIGN PATENT DOCUMENTS 69 710 1/1983 European Pat. Off. .

*Primary Examiner*—Joseph J. Hail, III
*Assistant Examiner*—Jay A. Stelacone
*Attorney, Agent, or Firm*—Pro-Techtor International

[57] ABSTRACT

A magazine system of a stapler, includes a main body, on its top side being provided with a gliding path outside the middle between both sides, the gliding path in turn symmetrically on both sides being provided with several grooves to accommodate U-shaped staples and straight nails of various sizes; a magazine case, surrounding the outside of the main body, leaving a gap on both lateral sides and on the top side; a pushing device, which is movable in the gap between the magazine case and the main body, surrounding the main body from above, and which by a spring pushes the staples or nails towards the ejector of the stapler; a movable part, which is connected to the main body and can be tilted away by a hinge. When using the stapler, the parts interact such that the staples or nails move along the main body and its gliding path and are driven by the driving force of the pushing device towards the ejector. When loading the staples or nails, the magazine case and the pushing device are pulled back and surround the movable part, then movable part is tilted away downwards for loading.

3 Claims, 7 Drawing Sheets

MAGAZINE SYSTEM OF A STAPLER

TECHNICAL FIELD

This invention relates to a kind of magazine system of a stapler, especially for both using U-shaped staples and straight nails, the staples and nails being easily loadable.

BACKGROUND ART

Conventional staplers can generally be classified into those using straight nails and those using U-shaped staples. Since staples and nails have a different shape, they cannot be loaded simultaneously into the magazine and thus cannot be used interchangeably Later, a kind of stapler both using straight nails and U-shaped staples of various widths was disclosed (Taiwan Patent No. 82211011 "Improved Staple Holder of a Stapler"). This kind of stapler is provided with an magazine, which is loadable with straight nails and U-shaped staples of various sizes. The nails or staples are by a guiding groove led into an ejector head to be ejected by means of an ejecting device. Therefore the effect of using straight nails and U-shaped staples of various sizes in a single stapler is attainable.

That kind of stapler, however, allows for use of nails of one size only, therefore it is of limited practical value in industrial use. Furthermore, when loading the nails or staples into the stapler, the magazine can tilted away only at a small angle, leaving little space for loading. This is uncomfortable, and the hand gets easily hurt at the ejector head. So there is a need for improvement.

The main objective of this invention consists in providing a magazine system of a stapler for using nails and staples of various shapes and sizes.

A further objective of this invention consists in providing a magazine system of a stapler allowing for low tool costs and an economical effect.

A further objective of this invention consists in providing a magazine system of a stapler, which is easily loadable with nails and staples The technical methods, structural parts and their function in order to achieve these and other objectives will become clear from the following embodiments and suitable related drawings.

BEST MODE TO CARRY OUT THE INVENTION

Figure 1:
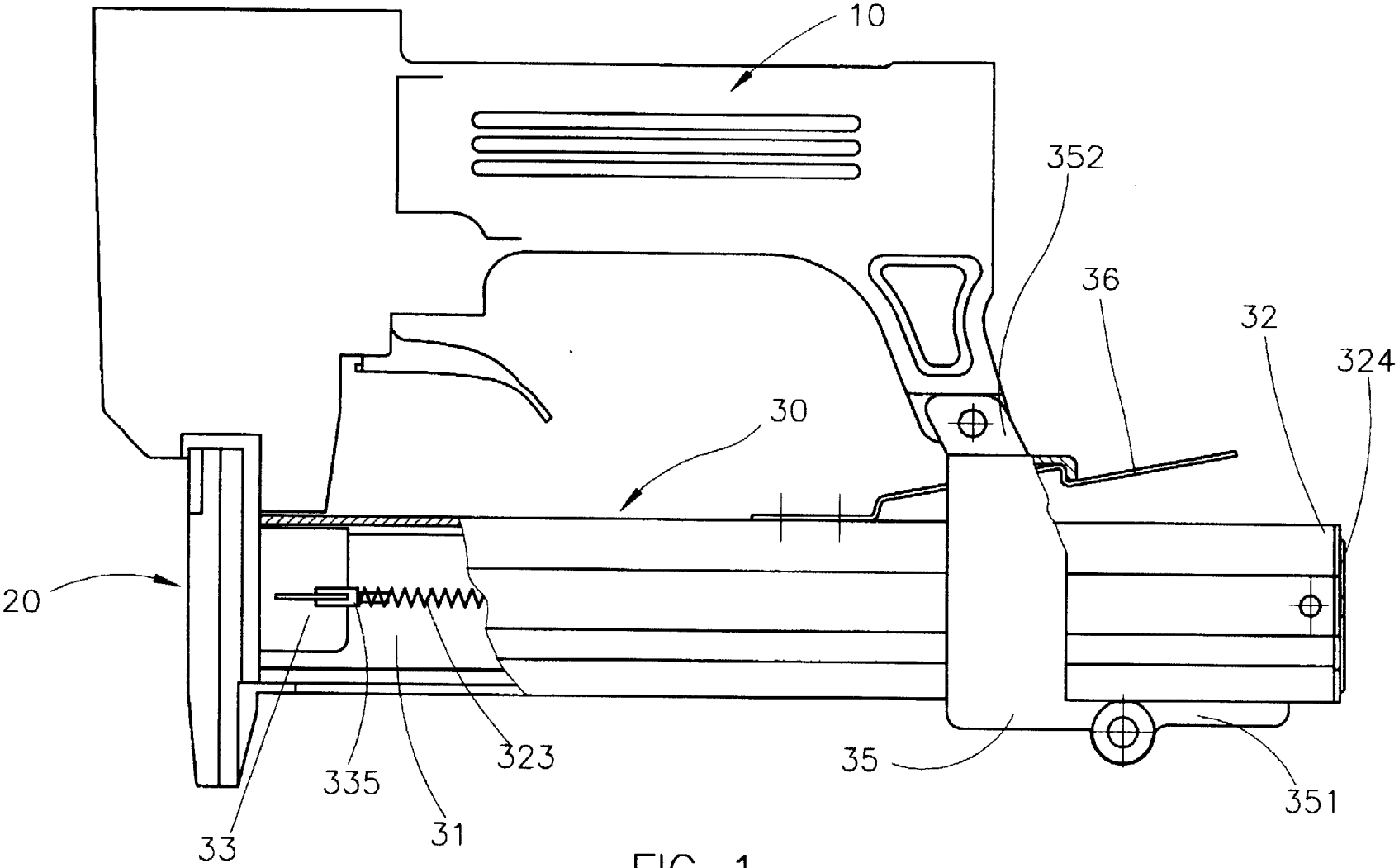
FIG. 1 is a schematic view of this invention in an assembled state to illustrate the mounting of the main body in the magazine case.

As shown in FIG. 1, this invention's magazine system of a stapler can be loaded with U-shaped staples of various size as well as with straight nails. The magazine essentially includes: a main body 31 and a magazine case 32, which are assembled together. After assembling, the main body 31 and the magazine case 32 can accommodate U-shaped staples of various widths and straight nails of various lengths, and using the pushing device 33 the staples or nails will be pushed towards the ejector 20. By means of a shooting device of the stapler (in the middle of the figure) the staples or nails will be ejected from the ejector 20. The main body 31 is provided with a link part 35 to let the movable part 34 hinge on the back end of the main body 31, such that the magazine case 32 of the magazine 30, after gliding back and surrounding only the movable part 34, can be turned away to load the stapes or nails.

Figure 3:
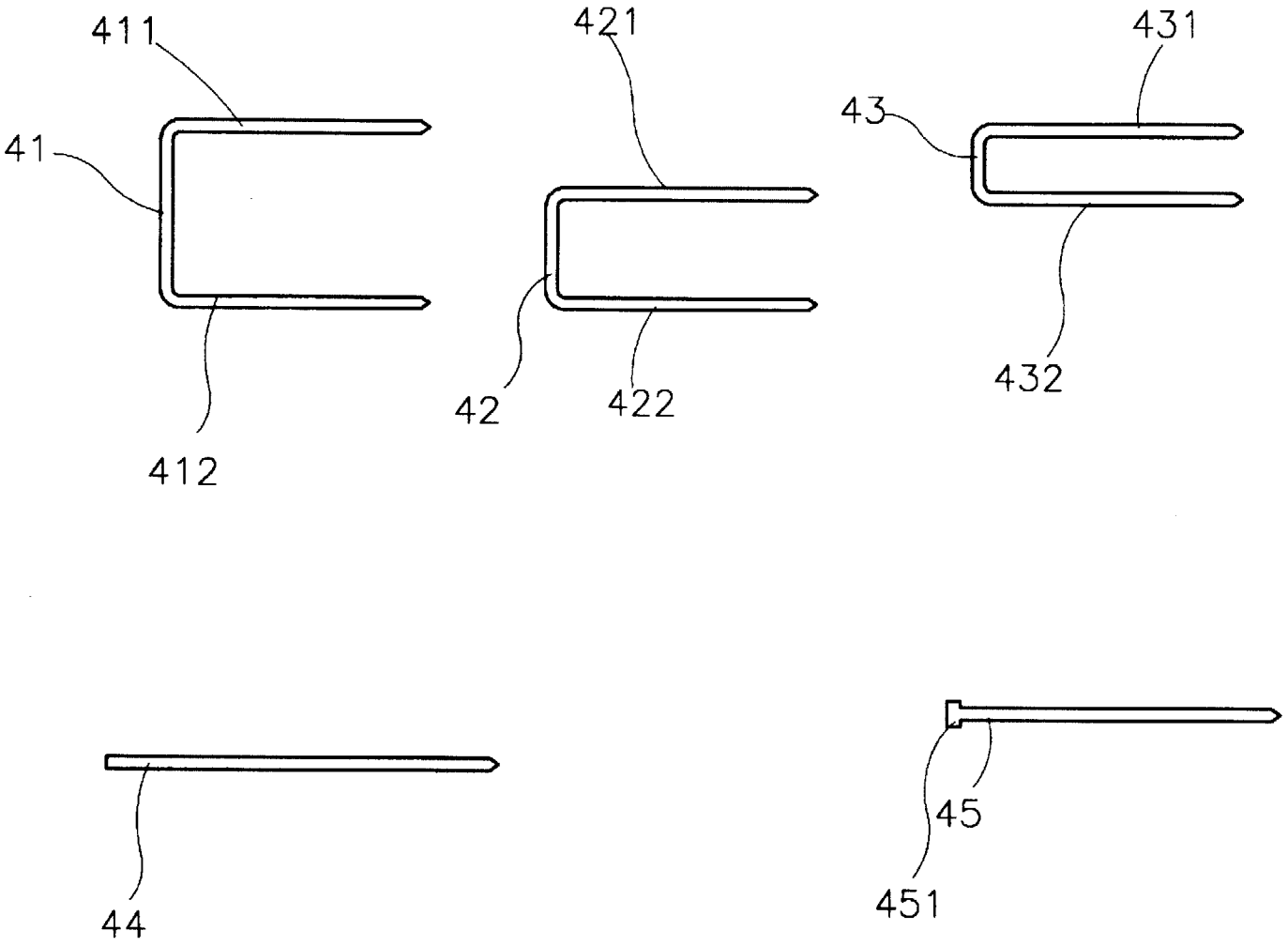
FIG. 3 is a schematic view of the staples and nails usable in this invention.
Figure 5:
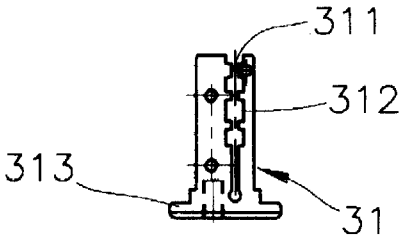
FIG. 5 is a side-view from the left of this invention's main body.
Figure 7:
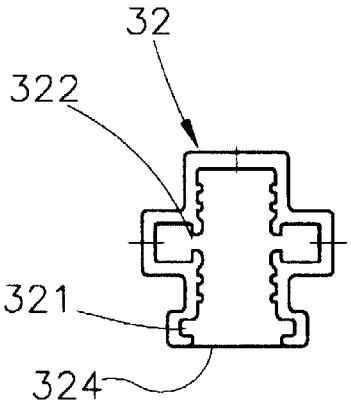
FIG. 7 is a side-view from the left of this invention's magazine case.
Figure 4:
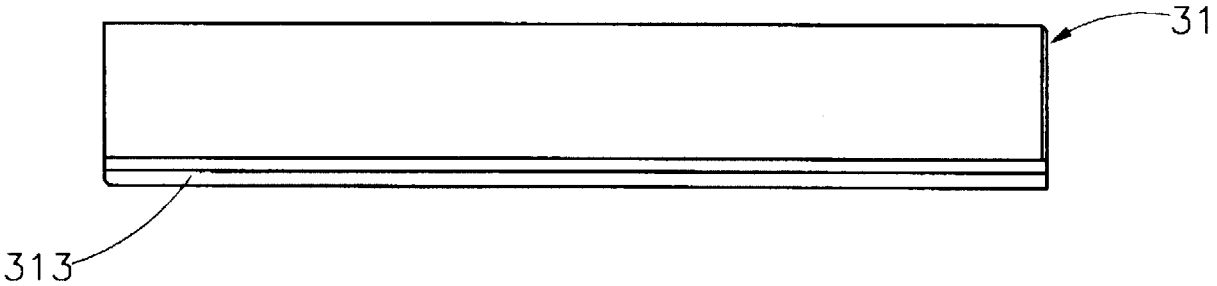
FIG. 4 is a front view of this invention's main body.
Figure 6:
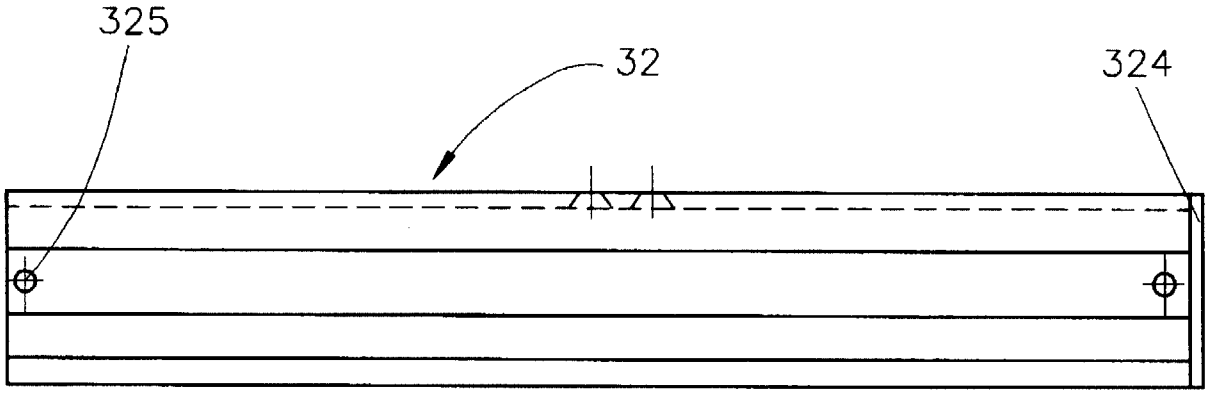
FIG. 6 is a front view of this invention's magazine case.

As shown in FIG. 3, the U-shaped staples of different sizes used in the magazine of this invention are divided into U-shaped staples of the largest width 41, of the second largest width 42 and of the smallest width 43. The mutual distance of the legs 421 and 422 of the U-shaped staples of the second largest width 42 added to the mutual distance of the legs 431 and 432 of the U-shaped staples of the smallest width 43 is equal to the mutual distance of the legs 411 and 412 of the U-shaped staples of the largest width 41.

The straight nails of different sizes used in magazine of this invention are divided into nails without head 44 and nails with head 45. As shown in FIGS. 1, 2, 4 and 5, the main body 31 has a rectangular cross section. The mutual distance of its lateral surfaces fits the width of the U-shaped staples 41 to sit glidingly on them. From the top surface of the main body 31 a gliding path 311 extends downwards. The gliding path 311 is situated off-center in the main body 31, allowing the U-shaped staples 42 to sit astride with one leg in the gliding path 311 and the other leg at one lateral surface of the main body 31. The U-shaped staples 43 may sit astride with one leg in the gliding path 311 and the other leg at the other lateral surface of the main body 31. The nails 44 can be glidingly accommodated in the gliding path 311. There are, in addition, several symmetric pairs of grooves 312 to accommodate the heads 451 of the nails with head 45 allowing them to glide in the gliding path 311. Thus on the main body 31 there may be U-shaped staples and straight nails of all sizes (as shown in FIGS. 14–21). By avoiding the limitations of only one size, but rather being able to use many sorts of staples or nails in this invention's magazine system of a stapler there is no need to purchase many staplers to use many sorts of staples or nails, and the tool costs are kept low.

Both sides of the main body 31 are at the bottom provided with an edge 313. The edges 313 protrude perpendicularly outwards, a certain distance away from the main body 31 to hold the magazine case 32 (see below).

Figure 2:
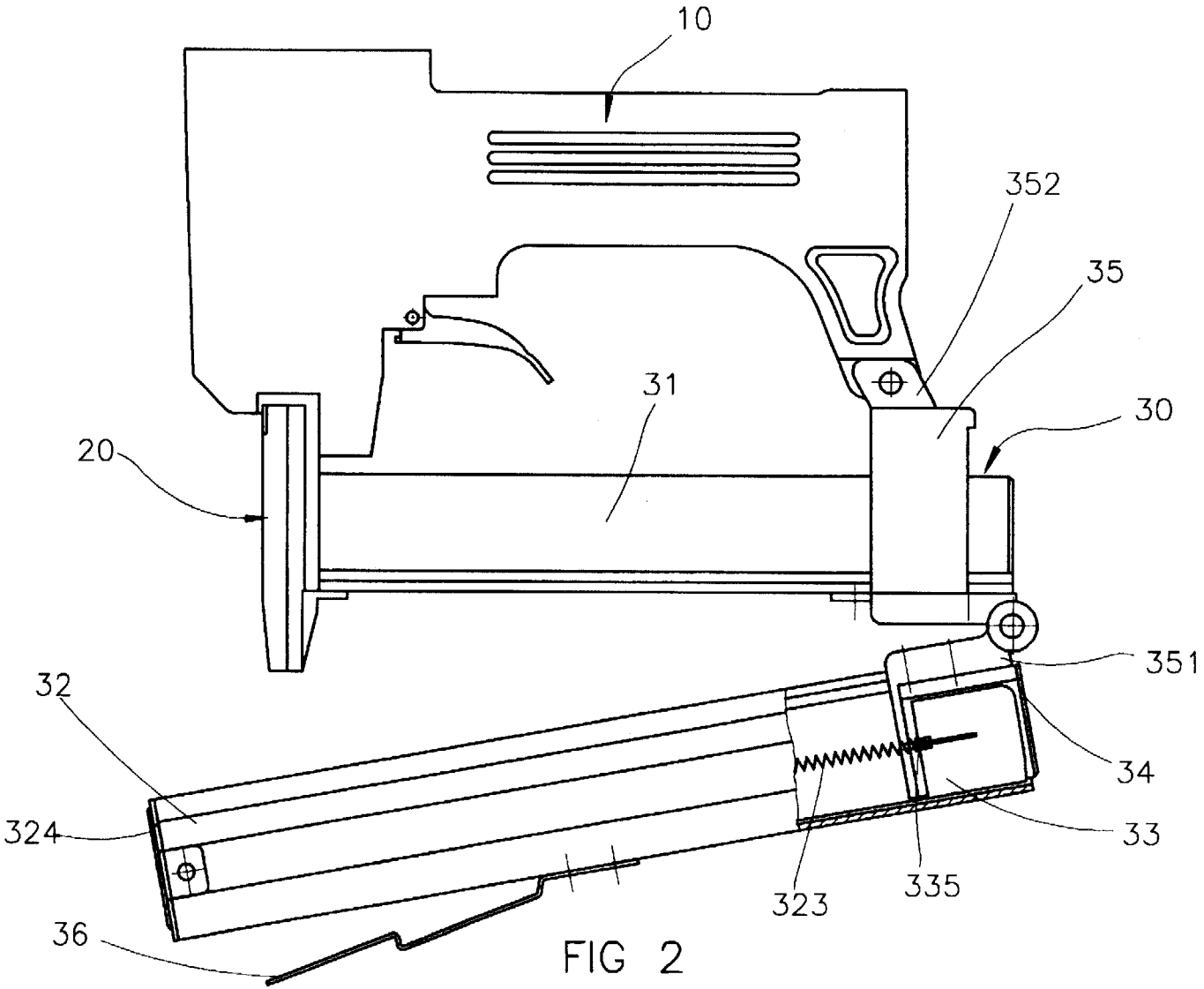
FIG. 2 is a schematic view of this invention in an assembled state to illustrate the position of the components when loading the nails or staples.
Figure 8:
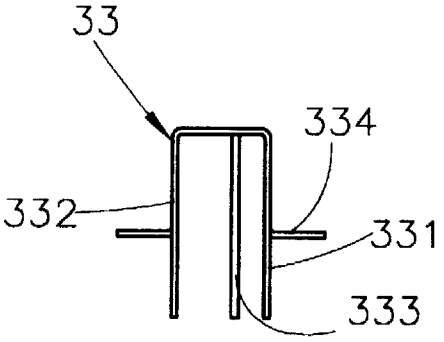
FIG. 8 is a schematic view of this invention's pushing device.
Figure 13:
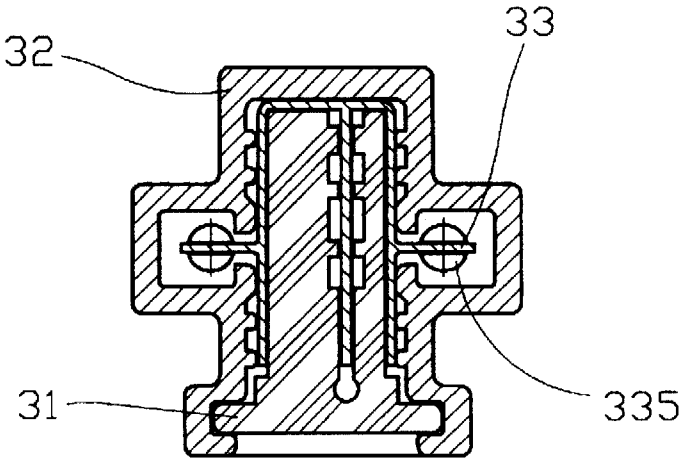
FIG. 13 is a sectional side-view of this invention illustrate the shape of this invention's main body, magazine case and pushing device after assembling.

As shown in FIGS. 1, 2 and 8, a pushing device 33 surrounds the main body 31 from above. The pushing device's 33 sectional view roughly looks like a U turned upside down. On both sides of the pushing device 33 two vertical walls sheets 331 and 332, one on each side, extend downwards to surround both sides of the main body. Between the vertical walls 331 and 332 an additional vertical wall 333 positioned off-center in the pushing device 33 extends downwards. Its position fits the position of the gliding path 311. So the vertical walls 331 and 332 will surround the main body 31, and the vertical wall 333 will enter the gliding path 311 to glide inside.

Furthermore the vertical sheets walls 331 and 332 each provided with a protruding edge 334. Both protruding edges 334 extend perpendicularly away from the vertical walls 331 and 332, respectively, to be hooked by a spring support 335 and hold the magazine case 32.

As shown in FIGS. 1, 2, 6 and 7, the sectional view of the magazine case 32 roughly looks like a U turned upside down. The magazine case 32 can surround the main body 31, leaving un both lateral sides and the top side a gap, which allows the U-shaped staples 41, 42 and 43 as well as the pushing device to glide within. Both sides of the magazine case 32 have at the bottom an outward protruding groove 321 each, into which the edges 313 of the main body 31 fit, such that the magazine case 32 will glide stably along the longitudinal axis of the main body 31. For loading the magazine with staples or nails the magazine case 32 can be pulled back. When loading U-shaped staples 41, both legs 411 and 412 will be put astride on the outer sides of the main body 31. When loading U-shaped staples 42 or 43, one leg will be placed in the gliding path 311, and the other leg on one of the outer sides of the main body 31. Nails of any sort to be loaded will be placed in the gliding path 311. After loading, the magazine case 32 will be pulled forward to surround the main body 31, preventing the staples or nails from falling out.

Both lateral inner sides of the magazine case 32 are further provided with two outward projecting accommodating grooves 322 to accommodate the protruding edges 334 of the pushing device 33. The accommodating grooves 322 also each accommodate a spring 323, which hooks the spring support 335. A ground plate 324, which is fastened to the back end of the magazine case 32 backs the spring 323, such that the pushing device 33 will be pressed forward by the spring 323. Close to the front end of the accommodating grooves 322 there are two stoppers 325, one in each accommodating groove, to stop the pushing device 33 on its way forward.

When the pushing device 33 moves towards the back end of the magazine case 32, compression of the spring 323, which is backed by the ground plate 324, leads to a contrary force driving the pushing device 33 back towards the ejector 20. Since the pushing element 33 takes the staples or nails with it, the staples or nails are in turn driven towards the ejector 20. After ejecting a single staple or nail, this driving force is still maintained.

When loading staples or nails, the magazine case 32 can be moved back. At the same time the stopper 325 pulls back the pushing device 33, such that the pushing device together with the magazine case 32 leaves the main body 31 and surrounds the movable part 34 to allow for comfortable loading.

Figure 10:
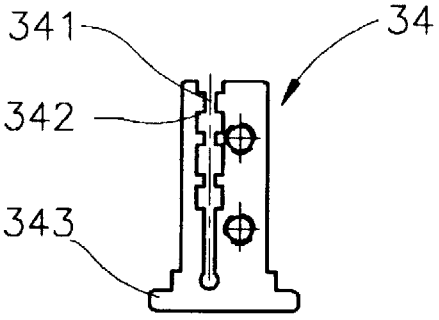
FIG. 10 is a side-view from the left of this invention's movable part.
Figure 9:
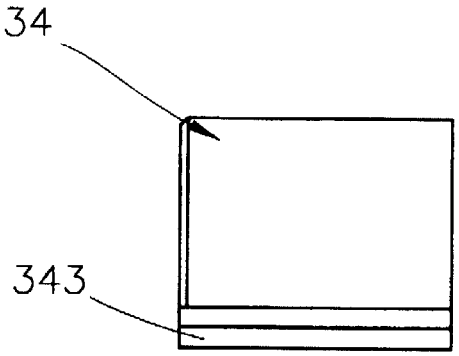
FIG. 9 is a front view of this invention's movable part.

As shown in FIGS. 2, 9 and 10 the movable part 34 uses the hinge of the link part to be connected to the main body 31. Its profile is equal to that of the main body 31. It is also provided with a gliding path 341, several symmetrical pairs of grooves 342 and a two edges 343. The movable part 34 can be fixed in a position where its longitudinal axis is an extension of the main body's longitudinal axis. So the magazine case 32 and the pushing device 33 can move back and surround the movable part 34. Having surrounded the movable part 34, they are separated from the main body 31. Now the movable part 34 together with the magazine case 32 and the pushing device 33 can be tilted away to allow for comfortable loading of the staples or nails.

Figure 11:
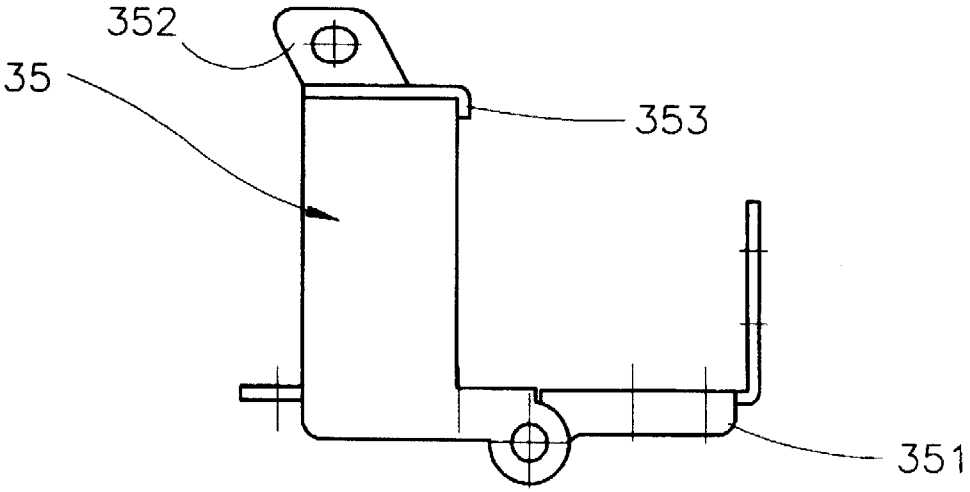
FIG. 11 is a front view of this invention's link part.

As shown in FIGS. 1, 2 and 11, the link part 35 is on the back end of its lower part provided with a connecting part 351. The connecting part 351 is fastened to the lower side of the movable part 34, such that the movable part 34 is by means of a hinge able to connect with the main body 31.

The link part 35 is further provided with an upward projecting shackle 352. The shackle is not linked to the magazine case 32, but surrounds it and is connected with the stapler 10 itself, fixing the magazine 30 to the stapler 10. On the lower end of the shackle 352 there is a blocking part 353, which using a blocking spring 36 on the top side of the magazine case 32 fixes the position of the magazine case 32.

Figure 12:
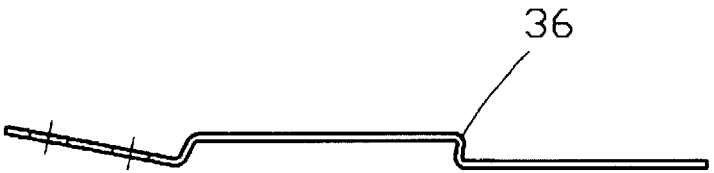
FIG. 12 is a schematic view of this invention's blocking spring.
Figure 17:
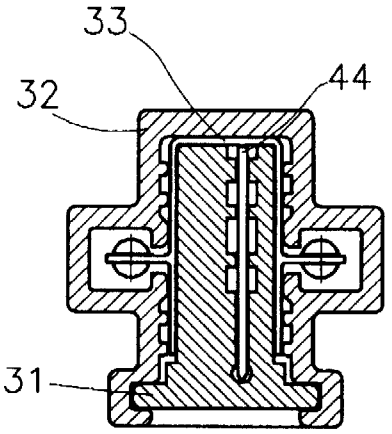
FIG. 17 is a sectional side-view of this invention to illustrate the loading of nails without head into the main body.
Figure 16:
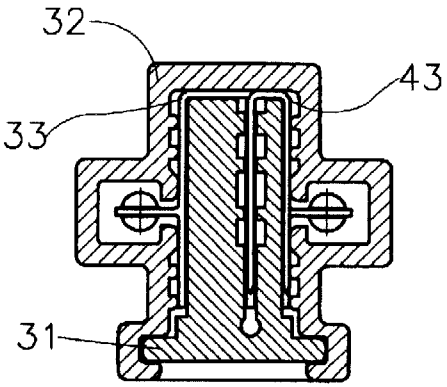
FIG. 16 is a sectional side-view of this invention to illustrate the loading of U-shaped staples of the smallest width into the main body.
Figure 15:
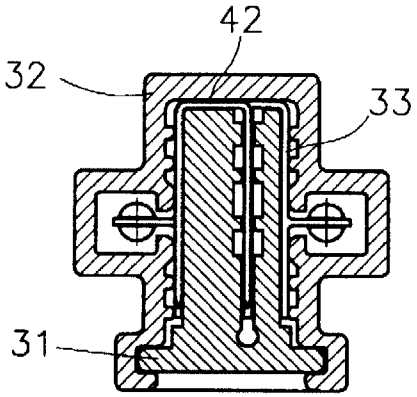
FIG. 15 is a sectional side-view of this invention to illustrate the loading of U-shaped staples of the second largest width into the main body.
Figure 14:
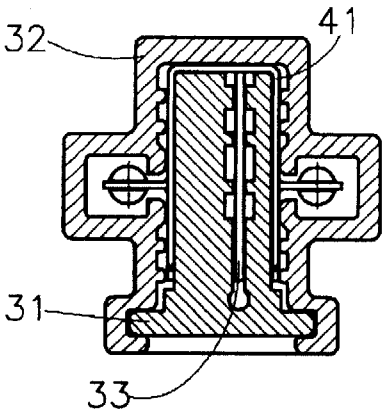
FIG. 14 is a sectional side-view of this invention to illustrate the loading of U-shaped staples of the largest width into the main body.
Figure 21:
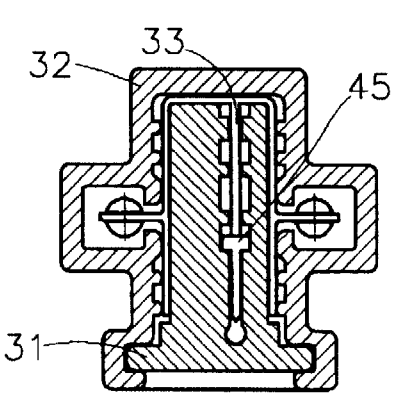
FIG. 21 is a sectional side-view of this invention to illustrate the loading of nails with head into the main body.
Figure 20:
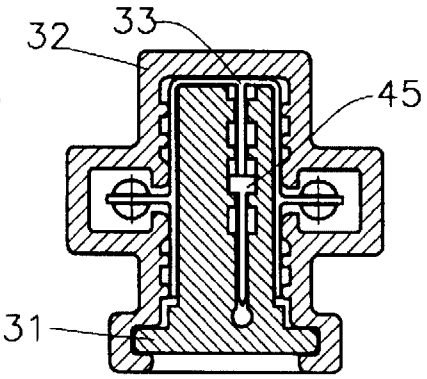
FIG. 20 is a sectional side-view of this invention to illustrate the loading of nails with head into the main body.
Figure 19:
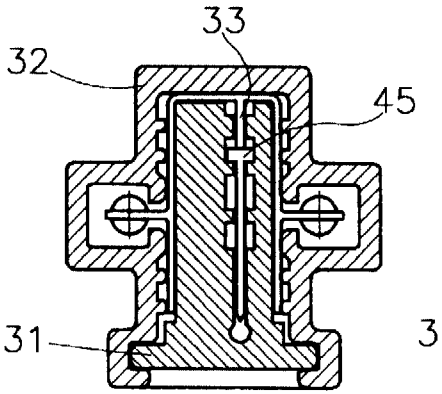
FIG. 19 is a sectional side-view of this invention to illustrate the loading of nails with head into the main body.
Figure 18:
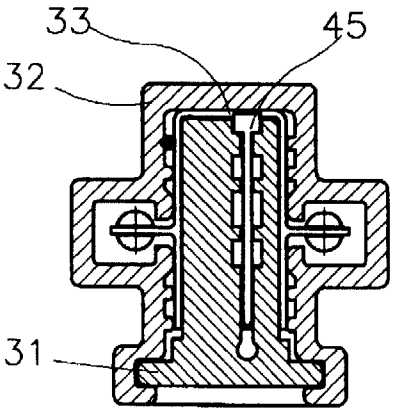
FIG. 18 is a sectional side-view of this invention to illustrate the loading of nails with head into the main body.

As shown in FIGS. 1, 2 and 12, the blocking spring 36 is fastened to the top side of the magazine case 32. When the magazine case 32 is pushed forward covering the main body 31 the blocking spring 36 leans against the blocking part 353 and does not allow for movement of the magazine case 32. When loading staples or nails the blocking spring 36 can be pressed down and be separated from the blocking part 353, such that the magazine case 32 can be pulled back for loading staples or nails.

What is claimed is:

1. A magazine system for a stapler comprising:

an elongated main body, a gliding path situated off-center in an interior of said main body, a plurality of grooves cut into side walls of said gliding path to accommodate heads of nails loaded into a magazine of said stapler as they travel along said gliding path, a pushing device that surrounds said main body to push staples or said nails through said magazine toward an ejector of said stapler, and a magazine case surrounding an exterior of said main body, said magazine case leaves a gap between said magazine case and said main body to accommodate said pushing device and said staples therein; wherein said staples are loaded astride said main body, a first leg of said staples is placed in said gap of said magazine case and a second leg of said staples is placed in either said gap on an opposing side of said main body or in said gliding path, depending upon the size of said staple, and nails without heads and nails with heads are placed in said gliding path, said heads of said nails with heads are received in one of said plurality of grooves in said gliding path, the groove utilized being dependent upon the length of said nails, such that said magazine system is adapted by means of said main body with said gliding path therein, to accommodate staples of varying widths, nails without heads and of varying lengths, and nails with heads and of varying lengths.

2. The magazine system of a stapler as claimed in claim 1 wherein:

a movable part is included and is movably attached to said main body via a link part such that a longitudinal axis of said movable part is coextensive with a longitudinal axis of said main body, allowing said magazine case and said pushing device to be moved from said main body onto said movable part so that said magazine case and said pushing device can be separated from said main body.

3. The magazine system of a stapler as claimed in claim 2 wherein:

said link part includes a blocking part and said magazine case includes a blocking spring such that when said magazine case is moved forward to surround said main body, said blocking spring engages with said blocking part to hold said magazine case in a fixed position, and said blocking spring can be depressed and separated from said link part to allow said magazine case to be retracted from said main body.

* * * * *